US005632688A

United States Patent [19]

Blaakman

[11] Patent Number: 5,632,688

[45] Date of Patent: May 27, 1997

[54] GOLF TIMER CONTROL

[76] Inventor: Frank L. Blaakman, 132 Cloverland Dr., Rochester, N.Y. 14610

[21] Appl. No.: 676,033

[22] Filed: Jul. 5, 1996

[51] Int. Cl.[6] ..... A63B 69/36

[52] U.S. Cl. ..... 473/198; 473/209; 473/277

[58] Field of Search ..... 473/198, 199, 473/207–209, 219, 221, 223, 224, 266, 274, 275, 268, 277

[56] References Cited

U.S. PATENT DOCUMENTS

| | | | |
|---|---|---|---|
| 4,560,166 | 12/1985 | Emerson | 473/209 |
| 5,395,116 | 3/1995 | Blaakman | 273/184 R |
| 5,553,857 | 9/1996 | Fish | 473/209 |

*Primary Examiner*—Mark S. Graham

[57] ABSTRACT

The present invention relates to an improved golf timer control (10) which functions to emit an audible signal to a golfer (26) after a pre-set time interval after striking a golf ball (30) with a golf club (28). The improved golf timer control (10) comprises: A) a housing (12) which comprises; I) a housing top (12A) having a housing top display opening (12AA) therein, and ii) a housing bottom (12B) securely and connected to the housing top (12A) by a housing left side (12CL), a housing right side (12CR), a housing front (12D), and a housing rear (12E). The housing front (12D) has a housing front control UP button opening (12DA), a housing front control DOWN button opening (12DB), a housing front power button opening (12DC), a housing front speaker opening (12DD), and a housing front microphone opening (12DE) therein. The housing rear (12E) has a housing rear clip (12EA) securely attached thereto which functions to attach the housing (12) onto a user. A pair of control buttons (14), speaker (16), a power button (18), a microphone (22), a display (24) contained within the housing (12) and electrically connected to the microprocessor (32). The speaker (16) functions to emit the audible sound after the pre-set time interval. The microphone (22) functions to receive an audible sound generated from the golf club (28) hitting the golf ball (30). The display (24) functions to visually exhibit the pre-set time to the golfer (26).

4 Claims, 7 Drawing Sheets

Strain Guage Transducer

Quartz or Ceramic Cartidge Transducer

Condenser Microphone

Golf Ball Strike Point Trigger Generator

Countdown Timer & Display

GOLF TIMER CONTROL

BACKGROUND OF THE INVENTION

1. Field of the Invention

The present invention relates to a golf timer control and more particularly, pertains to a golfing aid to provide an audio signal indicating when a golfer may lift his or her head after hitting the ball.

2. Description of the Prior Art

The use of golf aids are well known in the prior art. More specifically, golf aids heretofore devised and utilized for the purpose of improving performance are known to consist basically of familiar, expected and obvious structural configurations, notwithstanding the myriad of designs encompassed by the crowded prior art which have been developed for the fulfillment of countless objectives and requirements.

In this respect, the golf timer control according to the present invention substantially departs from the conventional concepts and designs of the prior art, and in so doing provides an apparatus primarily developed for the purpose of providing a golfer with a signal as to when his or her head may be lifted after hitting a shot.

Therefore, it can be appreciated that there exists a continuing need for new and improved golf timer control which can be used to provide a signal when his or her head may be lifted after hitting the ball. In this regard, the present invention substantially fulfills this need.

Numerous innovations for golf aids have been provided in the prior art that are described as follows. Even though these innovations may be suitable for the specific individual purposes to which they address, they differ from the present invention as hereinafter contrasted.

In U.S. Pat. No. 5,395,116, titled, GOLF TIMER CONTROL, by inventor Blaakman, the same inventor as the present invention, a golfing aid is disclosed and claimed which emits an audible signal to a golfer at a pre-determined lapsed time after hitting the golf ball. The device has a microphone which can detect a golf ball hitting sound and emit a signal in response thereto. The microphone is located at the butt end of a golf club grip. A microprocessor having a control means is also positioned in the grip of a golf club at the end thereof remote from the butt end. The present invention differs from the previous patented invention because it overcomes the limitation of having to purchase different and separate devices for each golf club. The present invention is a single compact unit which is easily worn on a golfer's belt and is therefore separate and distinct from the previous invention.

Innovations for golf aids have been provided in the prior art that are adapted to be used. Even though these innovations may be suitable for the specific individual purposes to which they address, they would not be suitable for the purposes of the present invention as heretofore described.

SUMMARY OF THE INVENTION

In view of the foregoing disadvantages inherent in the known types of golfing aids now present in the prior art, the present invention provides an improved golf timer control. As such, the general purpose of the present invention, which will be described subsequently in greater detail, is to provide a new and improved golf timer control apparatus and method of use which has all the advantages of the prior art golf timer control and none of the disadvantages.

To attain this, the present invention essentially composes a new and improved golfing aid to emit an audible signal to a golfer at a predetermined lapsed time after hitting a golf ball. The improved golf timer control comprises, in combination, a housing having a housing rear with a housing rear clip positionable over a golfer's belt, the housing adapted to support a microphone and a microprocessor thereadjacent. The microphone is contained within the housing. The microphone is adapted to detect the sound of a golf club hitting a golf ball and to generate a signal in response thereto. The microprocessor has a speaker for an audible sound. The speaker is adapted to be energized at a predetermined lapsed time following the detection of the signal by the microphone. A control means consisting of a housing front control UP button opening and a housing front control DOWN button opening electronically connected to the microprocessor allows a golfer to vary the predetermined lapsed time. A display mounted within the housing exhibits the preselected lapsed time. Electrical connections are present coupling the microphone and microprocessor for transmitting the signal generated by the microphone to the microprocessor for initiating the predetermined time delay prior to the emitting of the audio sound.

It is therefore an object of the present invention to provide a new and improved golf timer control which has all the advantages of the prior art golfing aids and none of the disadvantages.

It is another object of the present invention to provide a new and improved golf timer control which may be easily and efficiently manufactured and marketed.

It is a further object of the present invention to provide a new and improved golf timer control which is of a durable and reliable construction.

An even further object of the present invention is to provide a new and improved golf timer control which is susceptible of a low cost of manufacture with regard to both materials and labor, and which accordingly is then susceptible of low prices of sale to the consuming public, thereby making such golf timer control economically available to the buying public.

Still yet another object of the present invention is to provide a new and improved golf timer control which provides in the apparatuses and methods of the prior art some of the advantages thereof, while simultaneously overcoming some of the disadvantages normally associated therewith.

Still another object of the present invention is to assist a golfer in improving his or her swing by generating a signal at a predetermined lapsed time after hitting a shot as an indicator that his or her head may be lifted.

Yet another object of the present invention is to generate a signal whereby a golfer may thereafter life his or her head and thereby improve concentration, swing and score.

The types of problems encountered in the prior art are golfers often lift their heads up shortly after hitting the golf ball.

In the prior art, unsuccessful attempts to solve this problem were attempted namely: dual locations for a microphone and speaker and microprocessor limit the user to only utilizing one golf club or changing the device therebetween. However, the problem was solved by the present invention because it is contained within one housing and attachable onto a golfers belt.

Innovations within the prior art are rapidly being exploited in the field of golf aids.

The present invention went contrary to the teaching of the art which teaches golf aids attachable to a golf club.

The present invention solved a long felt need for one golf timer which could be utilized with all golf clubs without having to change therebetween.

The present invention produced unexpected results namely: the golfer attained more concentration on his game and thus improved his overall score.

Accordingly, it is an object of the present invention to provide an improved golf timer control.

More particularly, it is an object of the present invention to provide an improved golf timer control comprising a housing which comprises a housing top, a housing bottom, a housing side, a housing front, and a housing rear.

In keeping with these objects, and with others which will become apparent hereinafter, one feature of the present invention resides, briefly stated, in the housing top having a housing top display opening within which a display is mounted.

When the housing from is designed in accordance with the present invention, it comprises a housing front control UP button opening which contains a control UP button, a housing front control DOWN button opening which contains a control DOWN button, a housing front power button opening which contains a power button, a housing front speaker opening which contains a speaker, a housing front microphone opening which contains a microphone.

In accordance with another feature of the present invention, the housing front may have optional indicia thereon.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10 - improved golf timer control (10)

12 - housing (12)

12A - housing top (12A)

12AA - housing top display opening (12AA)

12B - housing bottom (12B)

12C - housing side (12C)

12D - housing front (12D)

12DA - housing front control UP button opening (12DA)

12DB - housing front control DOWN button opening (12DB)

12DC - housing front power button opening (12DC)

12DD - housing front speaker opening (12DD)

12DE - housing front microphone opening (12DE)

12E - housing rear (12E)

12EA - housing rear clip (12EA)

14 - control button (14)

14A - control UP button (14A)

14B - control DOWN button (14B)

16 - speaker (16)

18 - power button (18)

20 - indicia (20)

22 - microphone (22)

24 - display (24)

26 - golfer (26)

28 - golf club (28)

30 - golf ball (30)

32 - microprocessor (32)

DESCRIPTION OF THE PREFERRED EMBODIMENT

Figure 1:
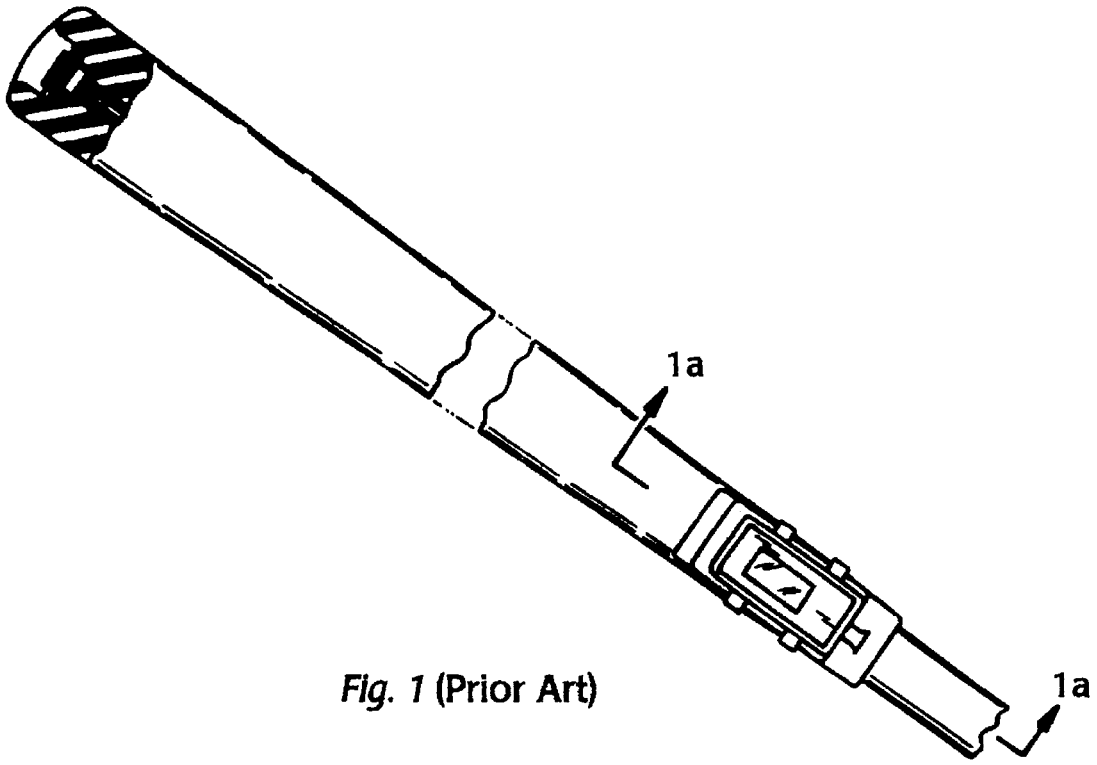
Fig. 1 (Prior Art)
FIG. 1 is a top partial cross-sectional view of a prior art golf timer control integrally mounted within a golf club handle.
Figure 1A:
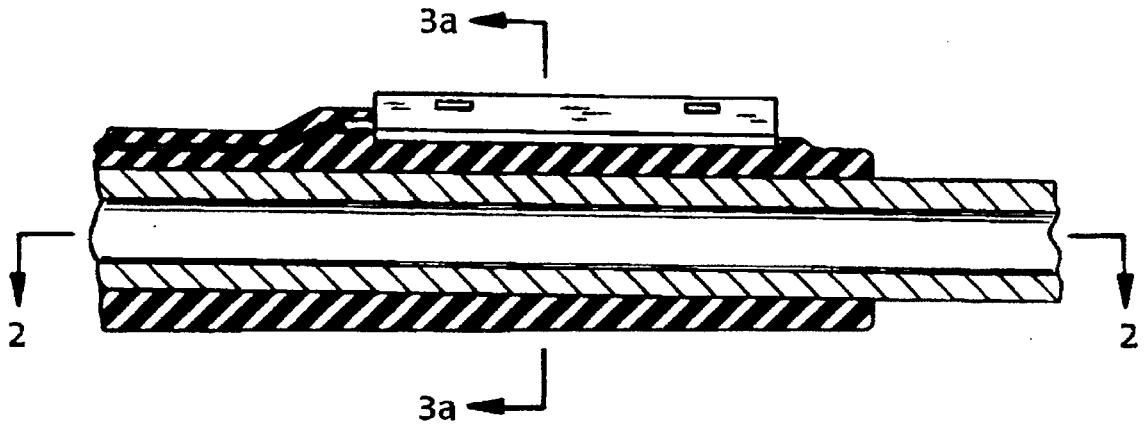
Fig. 1a (Prior Art)
FIG. 1A is a cross-sectional view along line 1A—1A of FIG. 1 of a prior art golf timer control integrally mounted within a golf club handle.
Figure 2:
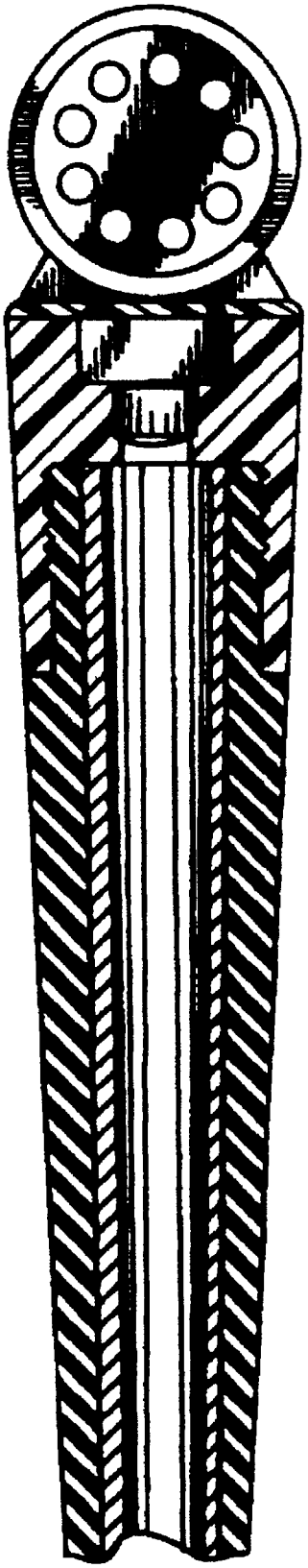
Fig. 2 (Prior Art)
FIG. 2 is a cross-sectional view along line 2—2 of FIG. 1A of a prior art golf timer control integrally mounted within a golf club handle.
Figure 2A:
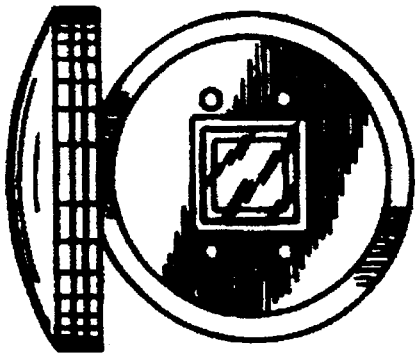
Fig. 2a (Prior Art)
FIG. 2A is a top view of a prior art golf timer control integrally mounted within a golf club handle.
Figure 3:
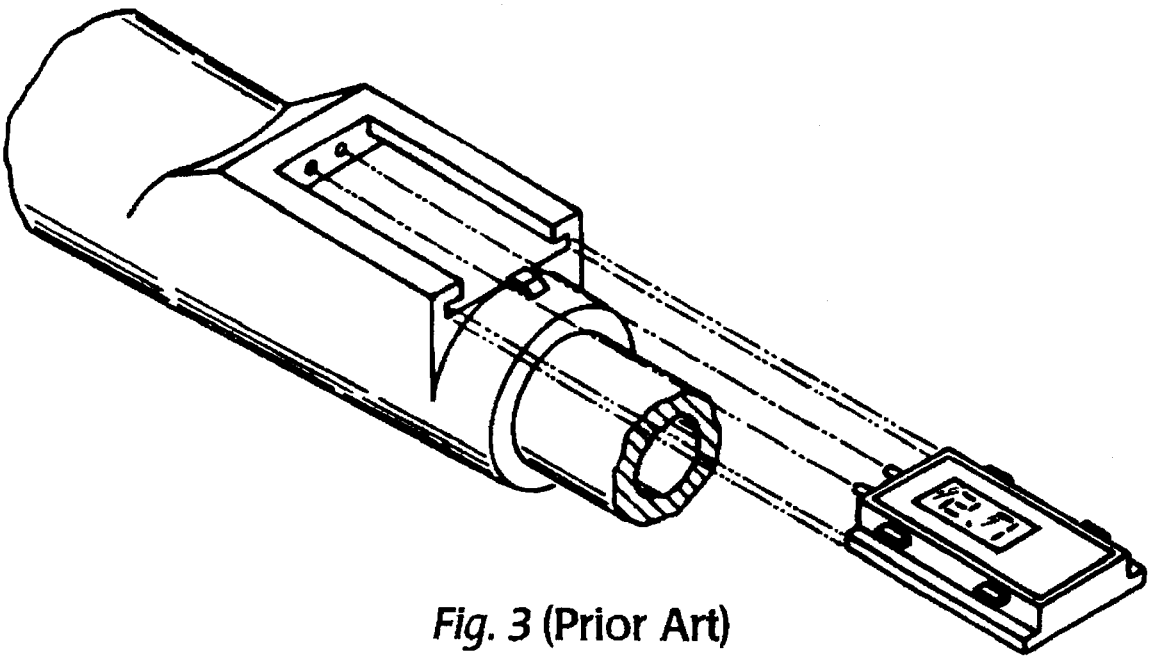
Fig. 3 (Prior Art)
FIG. 3 is a perspective view of a display of a prior art golf timer control integrally mounted within a golf club handle.
Figure 3A:
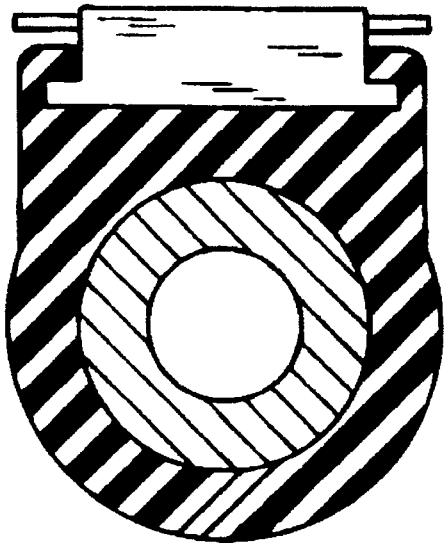
Fig. 3a (Prior Art)
FIG. 3A is a cross-sectional view along line 3A—3A of FIG. 1A of a prior art golf timer control integrally mounted within a golf club handle.

Firstly, referring to FIG. 1 which is a top partial cross-sectional view, FIG. 1A which is a cross-sectional view along line 1A—1A of FIG. 1, FIG. 2 which is a cross-sectional view along line 2—2 of FIG. 1A, FIG. 2A which is a top view, FIG. 3 which is a perspective view, and FIG. 3A is a cross-sectional view along line 3A—3A of FIG. 1A of a prior art golf timer control integrally mounted within a golf club handle. The prior art device shows the microprocessor, speaker, timer, control means, display, buttons, programmer, and two-pin connector all mounted on the golf dub and therefore requiring removal and re-attachment to another golf dub or purchasing a separate golf aid for each club. The improved golf timer control (10) is mountable on a belt and therefore can be utilized on all clubs.

Figure 4C:
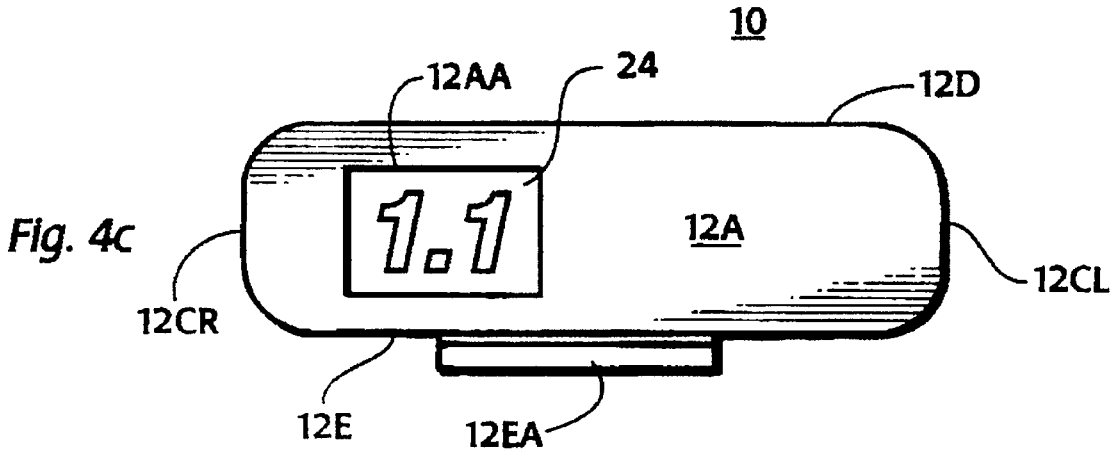
FIG. 4C is a top view of an improved golf timer control (10).
Figure 4:
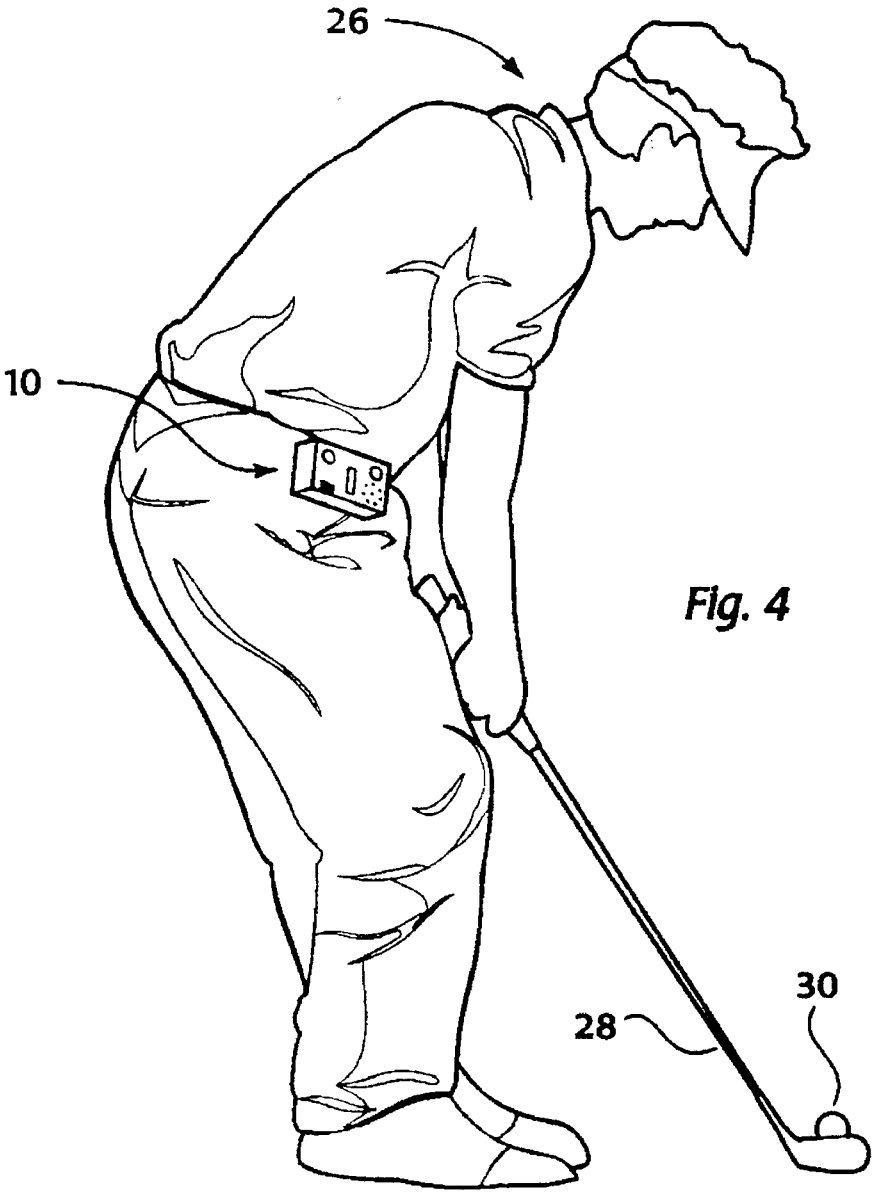
FIG. 4 is perspective rear view of a golfer (26) with an improved golf timer control (10) attached to his belt, hitting a golf ball (30) with a golf club (28).

Referring to FIG. 4 which is perspective rear view of a golfer (26) with an improved golf timer control (10) attached to his belt, hitting a golf ball (30) with a golf club (28). When the improved golf timer control (10) detects the sound of hitting the golf ball (30) by a microphone (22), a microprocessor (32) is activated which contains a timer having a preset time lapse. When the preset time lapse expires an audible sound is emitted through a speaker (16) indicating to the golfer (26) that he may now lift up his head from the golf ball (30) striking position.

Figure 4A:
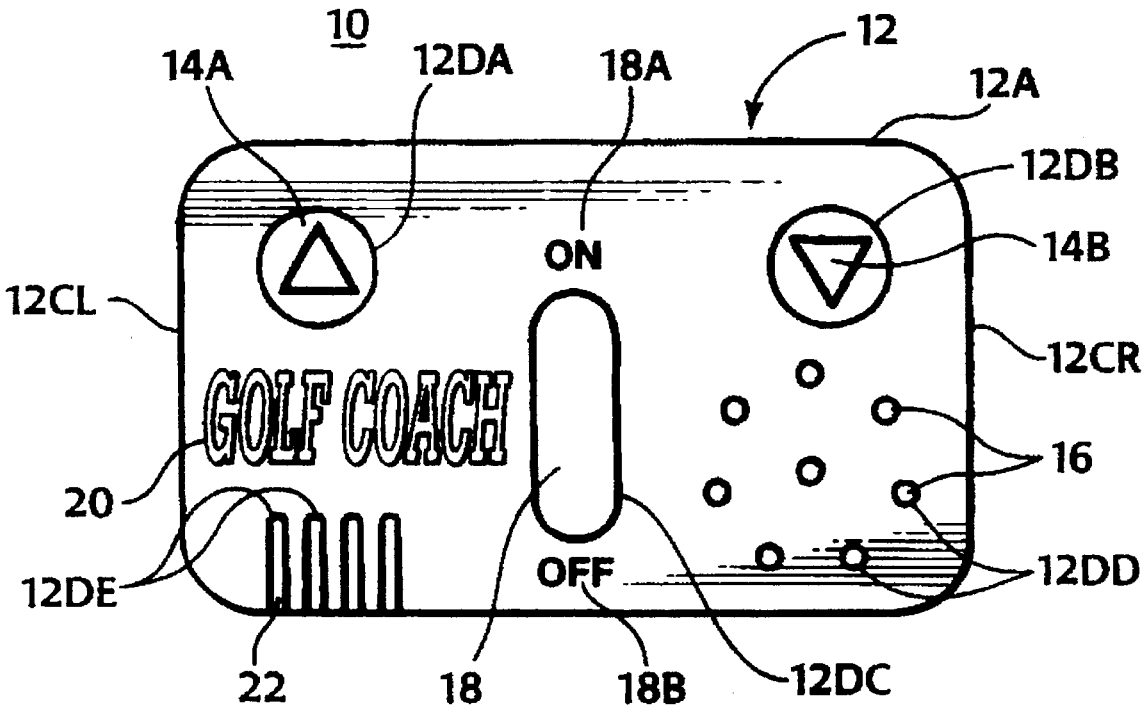
FIG. 4A is a front view of an improved golf timer control (10).

Now referring to FIG. 4A which is a from view of an improved golf timer control (10) comprising a housing consisting of housing top (12A), a housing bottom (12B), a housing left side (12CL), a housing fight side (12CR), a housing front (12D), and a housing rear (12E). The housing front (12D) comprises a housing from control UP button opening (12DA) containing a control LIP button (14A), a housing front control DOWN button opening (12DB) containing a control DOWN button (14B), a housing front power button opening (12DC) containing a power button (18), a plurality of housing front speaker openings (12DD) having at least one speaker (16) mounted therebehind, and a plurality of housing front microphone openings (12DE) having at least one microphone (22) therebehind. The housing front (12D) further comprises a power button ON indicator (18A) and a power button OFF indicator (18B) printed thereon at adjacent respective positions to the power button (18). A optional indicia (20) indicating the make and model of the improved golf timer control (10) may also be printed on the housing front (12D).

Figure 4B:
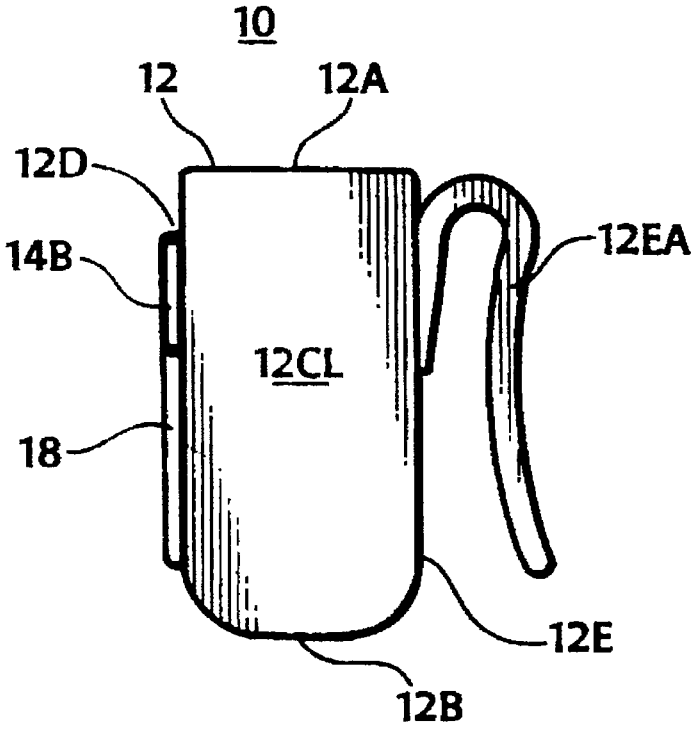
FIG. 4B is a left side view of an improved golf timer control (10).

Referring to FIG. 4B which is a left side view of an improved golf timer control (10). The buttons of which the control DOWN button (14B) and the power button (18) are shown, protrude slightly from the housing front (12D) which functions to facilitate depression of the buttons thereon. The housing top (12A) is preferably flat to facilitate visual reading of the display (24) mounted therein. The housing bottom (12B) is preferably rounded having a complimentary radius to the radius of a standard power means (34), a battery, contained therein. The housing rear (12E) has a housing rear clip (12EA) securely attached thereto which facilitates attachment to a golfer (26) via a belt or pocket.

Referring to FIG. 4C which is a top view of an improved golf timer control (10) exhibiting the housing top (12A) having a housing top display opening (12AA) within which a display (24) is mounted. The housing left side (12CL) and the housing right side (12CR) are slightly rounded to give an aesthetic appearance. The housing rear clip (12EA) is preferably thin as to not interfere with the golfer (26) during play.

More specifically, it will be noted that the present invention relates to an improved golf timer control (10). The improved golf timer control (10) functions to emit an audible signal from a microphone (22) to a golfer (26) at a predetermined lapsed time after hitting a golf ball (30) with a golf club (28).

Referring to FIG. 5A, 5B, 5C, 5D, and 5E which are an electrical schematic of a strain gauge transducer, a quartz or ceramic cartridge transducer, a microphone (22), a golf ball strike point trigger generator, and a countdown timer and display, respectively. The microprocessor (32) is positioned in the housing (12). The microprocessor (32) has an speaker (16) for an audible sound emission at a pre-determined time period after a golf club (28) hits a golf ball (30). The speaker (16) is adapted to be energized at a predetermined lapsed time following the generation of the signal by the microphone (22). Control buttons (14) which comprises a control UP button (14A) and a control DOWN button (14B) associated with the microprocessor (32), function to vary the predetermined time at the selection of the user. The display (24) shows the preselected time. Electrical connection are provided for coupling the microphone (22) for transmitting the signal generated by the microphone (22) to the microprocessor (32). This allows for initiating the pre-determined time delay prior to the emitting of the audio sound.

The circuitry within the microprocessor (32) further includes circuitry to effect a power down sleeper mode. In this manner, the power may shut down after a time of non-use. The present invention features a modular format arranged with the housing (12). The improved golf timer control (10) is composed of an electronic circuit which senses the sound of golf club (28) contact with a golf ball (30) which triggers a countdown timer within the microprocessor (32) and emits a beep via the speaker (16) at the end of a user specified lapsed time interval. The improved golf timer control (10) contains a transducer (36), trigger generator (38), timer microprocessor (40), display (24), tone output circuit (42) and a power means (34).

The power means (34) for this device can be a similar button cell or a photocell array capable of supplying the required current levels during normal operation.

Figure 5:
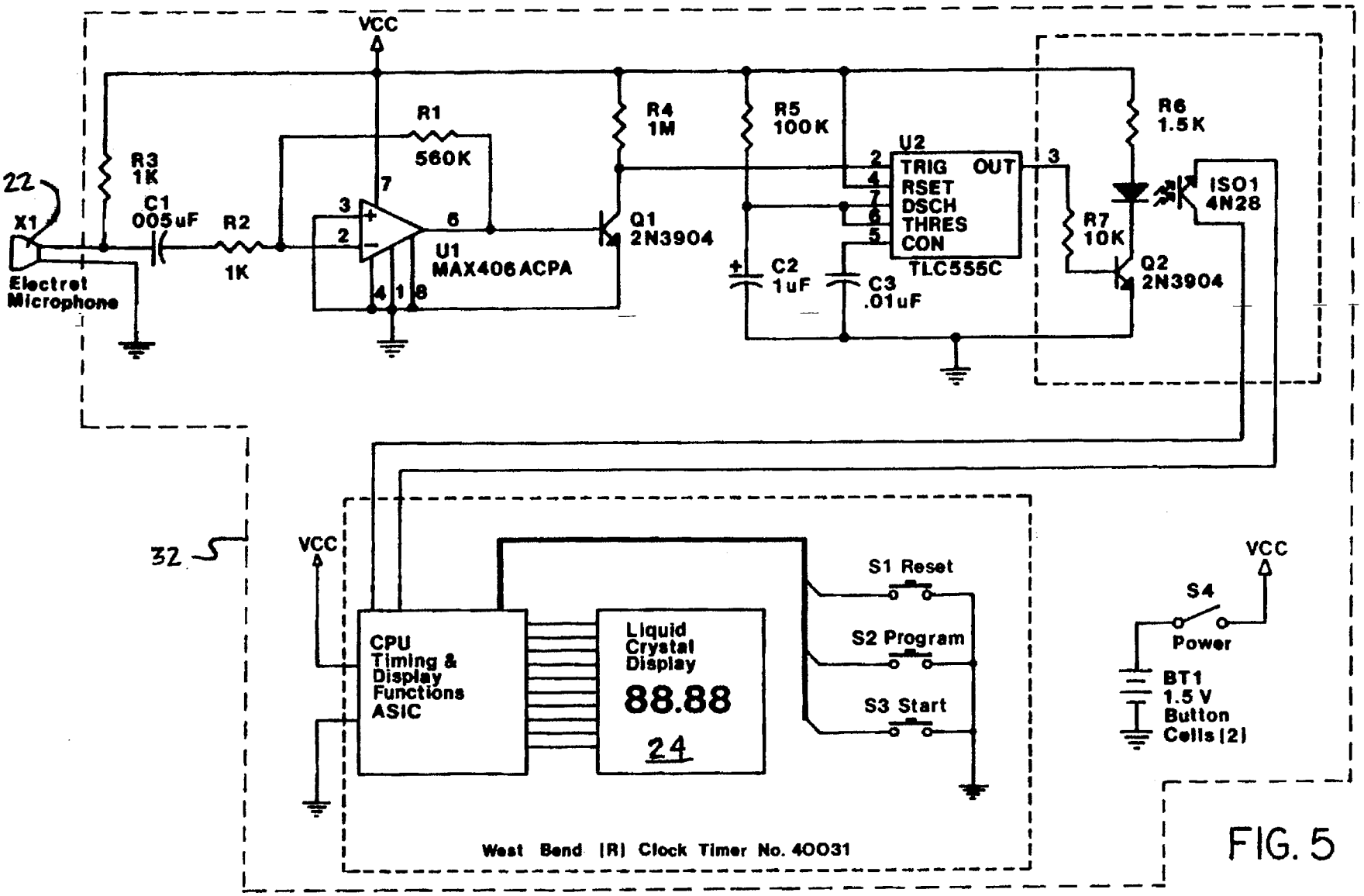
FIG. 5 is an electrical schematic of an improved golf timer control.
Figure 5A:
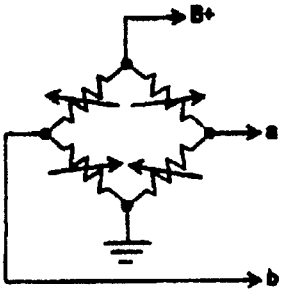
FIG. 5A is an electrical schematic of a strain gauge transducer.
Figure 5B:
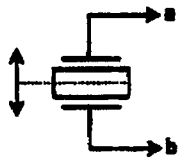
FIG. 5B is an electrical schematic of a quartz or ceramic cartridge transducer.
Figure 5C:
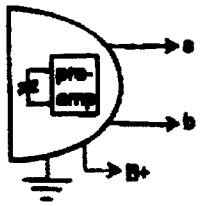
FIG. 5C is an electrical schematic of a microphone (22).
Figure 5D:
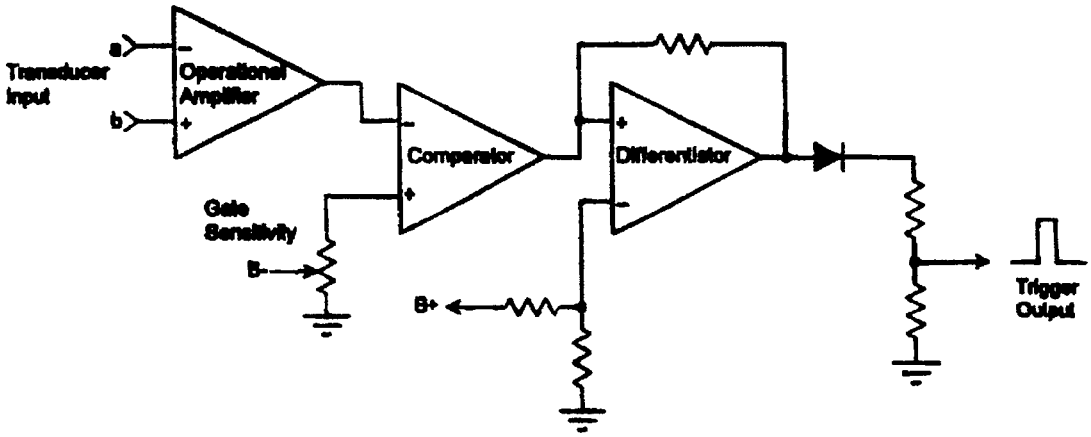
FIG. 5D is an electrical schematic of a golf ball strike point trigger generator.
Figure 5E:
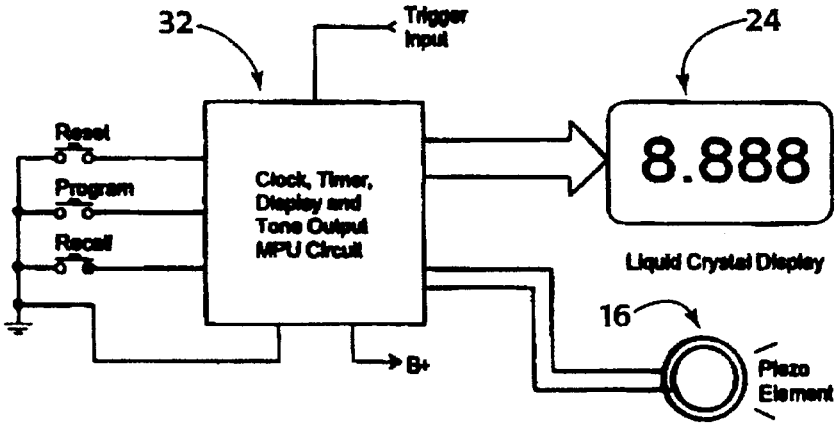
FIG. 5E is an electrical schematic of a countdown timer and display.

The trigger generator (38) consists of an trigger generator amplifier (38A) and signal shaping circuits which consist of a trigger comparator (38B) and a trigger differentiator (38C) to take the input transducer signal and create a square wave trigger. Three transducer configurations are depicted in FIGS. 5A, 5B and 5C. One of three transducers, strain gauge transducer (36A) or quartz/ceramic cartridge transducer (36B) or microphone (22) is selected as the optimum for cost and ease of use. A trigger comparator (38B) is employed to minimize false triggering which can be adjusted using the sensitivity control. The timer MPU is contained within the microprocessor (32) and is an integrated circuit similar to those utilized in wrist watches with reduced functionality. In FIG. 5E, the microprocessor (32) program is limited to providing the countdown functions using reset, program and recall buttons along with the ball strike trigger generator. The reset button provides a full reset of the improved golf timer control's (10) operating conditions. The control buttons (14) allow the user to specify the pre-set time interval used in the countdown and allows for stepping through increments of 10 milliseconds over a range of zero to five seconds. The power button (18) which also acts as a recall button when depressed is provided to wake up the display (24) as it is blanked during a "reduced power consumption" mode and provides an output showing the last timer interval specified by the user. At the end of a timer countdown, the improved golf timer control (10) drives a tone generator circuit to deploy an audible tone via a speaker (16) which is preferably a piezo-electric element for a duration of about one second. The timer MPU interfaces with a multiple digit liquid crystal display (24) for indication the timer interval during specification of such by the user. A microphone (22) with a sensitivity of −70 dB at 5 KHZ provides initial amplification of the audio signal produced at golf ball (30) impact. Resistor R3 supplies the microphone's (22) internal amplifier with power and current limiting. The signal is then coupled to an operational amplifier, U1, through capacitor C1. C1 provides isolation of the supply voltage for the microphone's (22) internal amplifier from the next stage of amplification and also limits the input frequency response which is optimized around 5 kilohertz. The MAX406ACA operational amplifier, U1, provides a voltage gain on the order of 560 times determined by resistors R1 and R2 which form an inverting OP amp configuration. U1 actually over amplifies the audio signal and causes the output signal voltage to swing rail to rail producing a square wave output. This square wave is then fed to transistor Q1, which simply acts as a switch and provides inversion of the signal to produce a negative going trigger.

This trigger is used to start a low power CMOS TLC555 timer, U2. This 555 is configured as a "one-shot" and runs in monostable mode. Capacitor C3 provides a noise immunity for the 555 timer by providing a path to bypass noise accumulated on the power input line. Capacitor C2 and resistor R5 combine to form an RC time constant which determines the output gate signal generated by the timer. The values selected produce a gate width of 100 milliseconds. This wider gate signal was required to properly activate the West Bend model 40031 clock timer and start its countdown timing. The gate signal is emitted from pin 3 of U2 and then coupled through a current limiting resistor, R7, to switching transistor Q2. While the gate is active high, transistor Q2 becomes forward biased which allows the LED in opto-isolator ISO1 to light. This then causes the photo transistor inside the opto-isolator to lower its junction resistance and emulate a key press of the West Bend unit start button thereby starting the user specified timing cycle 4. The collector and emitter leads from the transistor in the opto-isolator are connected directly in parallel with the start button in the West Bend unit. The area defined by the dashed-line box of the schematic groups a number of components required to interface the West Bend unit which will not be required in a production model. The production model incorporates an application specific integrated circuit (ASIC) containing the Head Down Timer Control's electronics coupled with essential portions of the West Bend unit. Switches S1 through S3, depicted in the schematic, are used to provide programming and manual activation capability to the user and are already an integral part of the West Bend timer unit. They are a subset of the entire complement of buttons in the unit which comprise the required functions for the invention.

The electrical schematic depicts the power means (34) and power button (18) switch. Power is preferably derived from two button cells, which provide three volts to the rest of the circuitry. The entire circuit draws a quiescent operating current of approximately 350 micro amps excluding the West Bend timer unit. This should provide ample life for the button cells during normal operation.

The West Bend Timer unit already incorporates an ASIC, which contains more functionality than required to perform the intended objectives of the invention. This model draws a fraction of the current consumed by the electronics. Optimally, the entire circuit should draw only about 200 micro amps to provide extended battery life, an achievable objective. An ASIC which incorporates the basic functionality of the Head Down Timer Control circuit and essential functions within the West Bend timer unit, would reduce the overall part count to approximately 12 components total.

The electret microphone (22), X1 on the schematic, is remotely located from the rest of the timer electronics and is contained within the housing (12). A mylar strip containing two lines of circuit trace is suitable for coupling the microphone's (22) output to the Head Down Timer Control circuit. The circuit design is subject to a number of revisions that can be applied to enhance performance or provide for equivalent functionality using other methods. One such enhancement is the incorporating of a power down "sleeper mode" where the circuit would draw even less current during idle periods and wake up on demand by depressing the power button (18). Alternate methods of producing the initial input signal can be employed and should be considered before producing a production model. The method chosen to acquire the input signal through an audio microphone (22) was selected based on availability and cost of suitable input transducers. Alternate transducers may provide better reliability and performance. Every attempt has been made to optimize the existing design to perform its intent without false triggering. The current design is relatively immune to false triggering from voices or other sources of audible sounds.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, all suitable modifications and equivalents may fall within the scope of the invention.

It will be understood that each of the elements described above, or two or more together, may also find a useful application in other types of constructions differing from the type described above.

While the invention has been illustrated and described as embodied in an improved golf timer control, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An improved golf timer control (10) which functions to emit an audible signal to a golfer (26) after a pre-set time interval after striking a golf ball (30) with a golf club (28), the improved golf timer control (10) comprising:

A) a housing (12) which comprises;

I) a housing top (12A) having a housing top display opening (12AA) therein, and ii) a housing bottom (12B) securely and connected to the housing top (12A) by a housing left side (12CL), a housing right side (12CR), a housing front (12D), and a housing rear (12E), the housing front (12D) having a housing front control UP button opening (12DA), a housing front control DOWN button opening (12DB), a housing front power button opening (12DC), a housing front speaker opening (12DD), and a housing front microphone opening (12DE) therein, the housing rear (12E) having a housing rear clip (12EA) securely attached thereto which functions to attach the housing (12) onto a user;

B) a microprocessor (32) contained within the housing (12);

C) a pair of control buttons (14) contained within the housing (12) and electrically connected to the microprocessor (32), the pair of control buttons (14) consist of a control UP button (14A) and a control DOWN button (14B) which function to adjust the pre-set time interval, the control UP button (14A) protruding through the housing front control UP button opening (12DA), the control DOWN button (14B) protruding through the housing front control DOWN button opening (12DB);

D) a power button (18) contained within the housing (12) and electrically connected to the microprocessor (32), the power button (18) protruding through the housing front power button opening (12DC);

E) a speaker (16) contained within the housing (12) and electrically connected to the microprocessor (32), the speaker (16) is positioned beneath the housing front speaker opening (12DD), the speaker (16) functioning to emit the audible sound after the pre-set time interval;

F) a microphone (22) contained within the housing (12) and electrically connected to the microprocessor (32), the microphone (22) positioned beneath the housing front microphone opening (12DE), the microphone (22) functioning to receive an audible sound generated from the golf club (28) hitting the golf ball (30);

G) a display (24) contained within the housing (12) and electrically connected to the microprocessor (32), the display (24) is contained within the housing top display opening (12AA), the display (24) functioning to visually exhibit the pre-set time to the golfer (26);

H) an electronic circuitry contained within the housing (12) and electrically connected to the microprocessor (32), the electronic circuitry comprising a transducer (36A,36B), a trigger generator (38) which consists of a trigger generator amplifier (38A) and a trigger comparator (38B) and a trigger differentiator (38C) and a trigger sensitivity control (38D), a timer microprocessor (40), and a tone output circuit (42); and I) a power means (34) contained within the housing (12) and electrically connected to the microprocessor (32).

2. The improved golf timer control (10) as described in claim 1, wherein the electronic circuitry further comprises a power down sleeper mode.

3. The improved golf timer control (10) as described in claim 1, wherein the housing front (12D) has a power button ON indicator (18A) and a power button OFF indicator (18B) adjacent to the housing front power button opening (12DC) which function to show a golfer (26) whether the improved golf timer control (10) is powered.

4. The improved golf timer control (10) as described in claim 1, wherein the housing (12) has indicia (20) thereon.

* * * * *